US008141467B1

(12) United States Patent
Corder

(10) Patent No.: US 8,141,467 B1
(45) Date of Patent: Mar. 27, 2012

(54) BULLET SIZING AND LUBRICATOR APPARATUS AND METHOD

(76) Inventor: Todd Anthony Corder, Plymouth, IL (US)

( * ) Notice: Subject to any disclaimer, the term of this patent is extended or adjusted under 35 U.S.C. 154(b) by 0 days.

(21) Appl. No.: 12/590,001

(22) Filed: Nov. 2, 2009

Related U.S. Application Data

(62) Division of application No. 11/328,773, filed on Jan. 11, 2006, now Pat. No. 7,637,193.

(51) Int. Cl.
*F42B 14/04* (2006.01)

(52) U.S. Cl. ..... 86/19; 86/24

(58) Field of Classification Search ..... 86/24, 1.1, 86/23, 28, 54, 19
See application file for complete search history.

(56) References Cited

U.S. PATENT DOCUMENTS 2,133,873 A * 10/1938 Sharp ..... 86/19
2,403,032 A * 7/1946 Stevens, Jr. ..... 86/19
2,510,430 A * 6/1950 Stevens, Jr. ..... 86/19
3,005,372 A * 10/1961 Hall ..... 86/19
3,736,835 A * 6/1973 Hanson ..... 86/19
3,967,526 A * 7/1976 Leich ..... 86/19
4,217,809 A * 8/1980 Hertzler ..... 86/19
4,462,298 A * 7/1984 Engles ..... 86/19
4,721,147 A * 1/1988 Evans ..... 164/155.5
4,817,491 A * 4/1989 Fenton ..... 86/19
6,912,943 B2 * 7/2005 Bolhassani ..... 86/19
7,637,193 B1 * 12/2009 Corder ..... 86/19

* cited by examiner

*Primary Examiner* — James Bergin
(74) *Attorney, Agent, or Firm* — Golden's M&I; James B. Golden

(57) ABSTRACT

A bullet sizing and lubrication device for use with reloading presses for improved operation and durability having a sizing die, lube valve, and lube actuator member. The sizing die has a centering portion for centering bullets to be sized and lubricated and at least one lube opening. The lube valve and lube actuator member has a first position where fluid is blocked from entering the at least one lube opening and a second position where fluid is communicated through the at least one lube opening. The principle use is for sizing and lubricating cast bullets, however, other components will benefit from this invention. For example, any number of applications where devices need to be sized and lubricated, such as, shafts and pins will benefit from this application.

9 Claims, 5 Drawing Sheets

BULLET SIZING AND LUBRICATOR APPARATUS AND METHOD

CROSS REFERENCE

This divisional application claims the benefit of the regular U.S. patent application No. 11/328,773 filed Jan. 11, 2006 now U.S. Pat. No. 7,637,193.

TECHNICAL FIELD

This invention relates generally to sizing and lubricating bullets and more particularly to a bullet sizing and lubricator having a tool head member that is adapted to receive a sizing die for centering and sizing bullets and a lube reservoir for lubricating sized bullets.

BACKGROUND ART

It is well known for sportsmen and hunters to cast their own lead bullets for improved performance, historical purposes, competitive shooting, economics, etc. The cast bullets are then used to "reload" or be assembled in cartridges for usage. In nearly all applications, the cast bullet needs to go through a process of sizing, i.e. swaging, and be lubricated prior to loading the bullet in a firearm for subsequent discharge.

Various designs have been developed in an attempt to aid individuals in sizing and lubricating bullets. Typical designs consist of a nose punch that holds the bullet needing to be sized and lubricated. An individual moves a handle in one direction (stroke length) for pressing the bullet into its associated die and movement of the handle in a second direction ejects the bullet out of the die. The individual then has to physically remove the sized and lubricated bullet from the nose punch being used.

There are a number of inherent problems associated with past designs. For instance, additional nose punches are needed to size and lube bullets of different lengths. The need for additional punches increases the cost of producing cast bullets and complexity due to the need to change nose punches for different type of bullets.

Another inherent problem is associated with lubricating bullets. Past designs utilize a pressurized reservoir that is integral with the device for applying lube to the cast bullet. Unfortunately, the pressurized lube is uncontrolled leading to leaks and drips that may damage or at least facilitate cleaning of equipment in the vicinity of the sizing and lubricating tool. In addition, having a fixed reservoir requires the user to take additional time to clean the reservoir when changing the type of lube being used. Furthermore, some applications may utilize viscous lubes that may benefit from being heated for better improved flow and past designs would require the entire device to be heated which is inefficient and wasteful.

Yet another problem, sizing of the cast bullet by use of a base plate or nose punch tend to have poor alignment between the bullet and the sizing die. The misalignment lends itself to sizing bullets crookedly, off center, and/or having one side scrubbed on the side of the die.

Yet another problem, with an increase in the types of firearms designed require that bullets be of increasing length and/or diameter and past designs are generally limited to the overall dimensions of the bullet being sized. For example, a bullet of additional length may not fit within the stroke length of the designed device. In addition, the mechanism for pressing the bullet into its associated sizing die may not have the required compound leverage that is needed to size the bullet.

Disclosure Of The Invention

In one aspect of the present invention, a die is used with a tool head member to size bullets which includes a bullet entrance portion that is adapted to receive a bullet. A lube portion that has at least one lube opening that is adapted to lube the bullet. A bullet exit portion that is adapted to expel the bullet. A bullet sizing bore that is defined by a longitudinal axis and the bullet sizing bore has a centering portion, a sizing portion, and a release portion.

In another aspect of the present invention, a tool head member is used with a reloading device which has a tool head support and adapter plate support to size and lubricate bullets. The tool head member has a sizing die bore that is defined by a first portion, a second portion, and an intermediate portion located between the first and second portions. A lube valve bore. A lube actuator bore. A lube well bore. A lube channel that is positioned between the lube well bore and the sizing die for fluidly coupling the lube well bore, the lube actuator bore, the lube valve bore, and the sizing die bore.

In yet another aspect of the present invention, a method of sizing and lubricating a bullet with an ammunition re-loader that has a tool head support and an adapter plate support. A tool head member that has a sizing die, a lube valve member, a lube valve actuator, and a lube well disposed therein, and an adapter plate that has a base punch, and a valve actuation punch. The method comprises the steps of placing the tool head member into the tool head support. Placing the adapter plate onto the adapter plate support. Placing the base punch and the valve actuation punch on the adapter plate. Placing a bullet on the base punch. Operating the ammunition re-loader by moving the adapter plate towards the tool head member. Engaging the bullet with the sizing die centers and sizes the bullet.

Engaging the valve actuator punch with the valve actuator member and the engagement permits fluid to flow from the lube well into the sizing die and about the bullet. Passing another bullet from the sizing die.

BEST MODE FOR CARRYING OUT THE INVENTION

Figure 1:
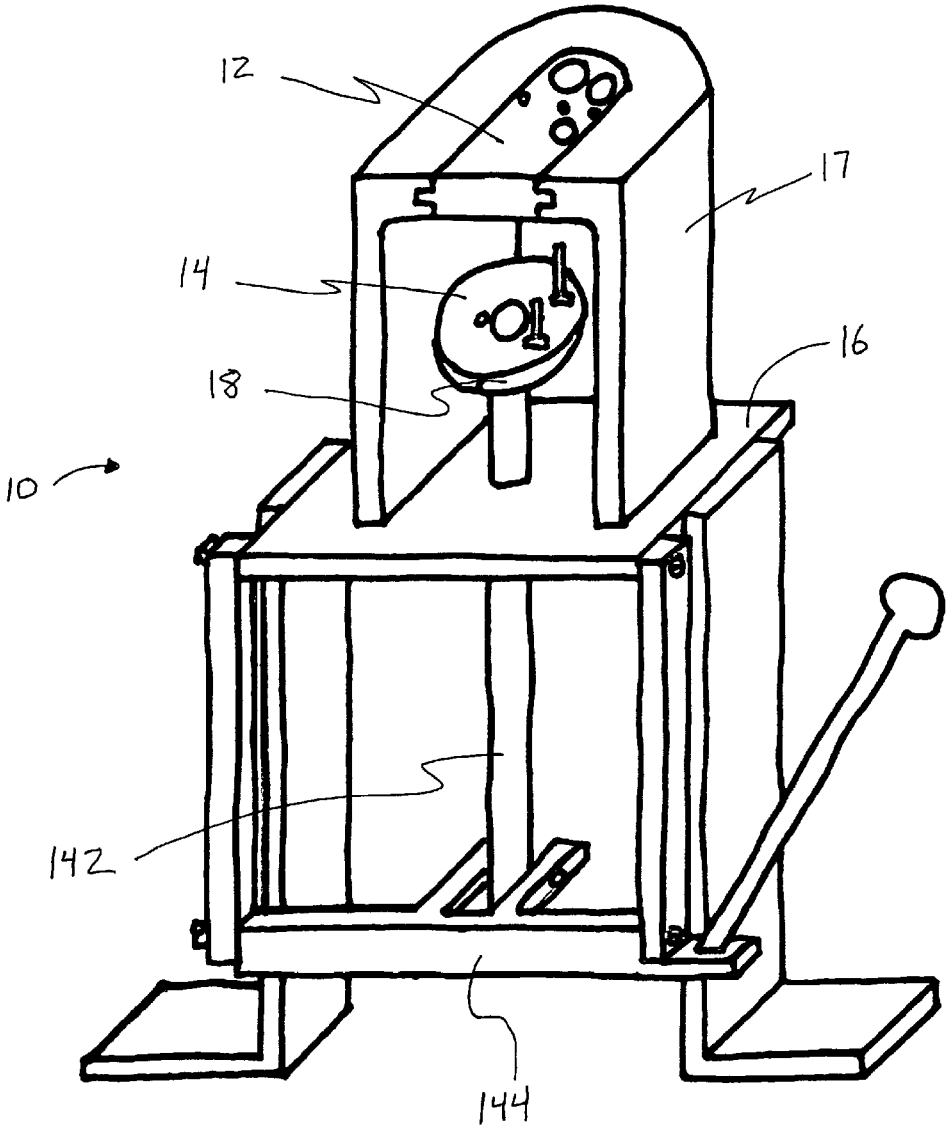
FIG. 1 is an isometric view of a bullet sizing and lubricator assembly of an embodiment of the present invention.

Turning to the drawing and particularly FIG. 1 representing a bullet sizing and lubricator assembly (10) is shown with one embodiment of the present invention. As seen therein, the bullet sizing and lubricator assembly (10) includes a tool head member (12) and an adapter plate member (14) that is easily adapted to a reloading press (16) using tool head support (17) and an adapter plate support (18) respectively. Reloading presses (16) are well known in the art for returning fired brass cases to a minimum dimension for reuse and have many different designs. Returning fired brass cases to dimensions desirable for reloading requires a magnitude of compound leverage that is advantages for sizing and lubricating bullets. The ability to interchange standard components used with reloading presses (16) with the tool head member (12) and adapter plate member (14) of the present invention permits various bullet sizes to be sized and lubricated in an efficient and cost effective manner. In addition, the use of the compound leverage inherent in reloading presses expands the range of usage for sizing and lubricating bullets (19).

Figure 2:
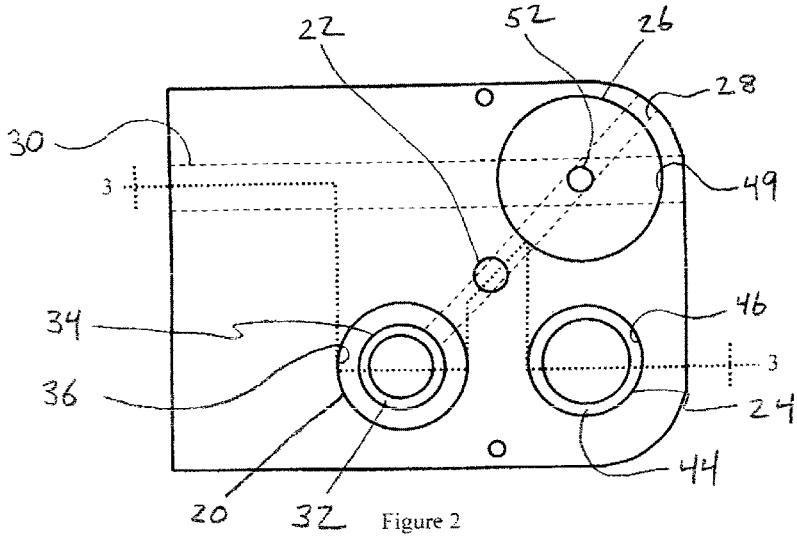
FIG. 2 is a top view of a tool head member of an embodiment of the present invention.
Figure 3:
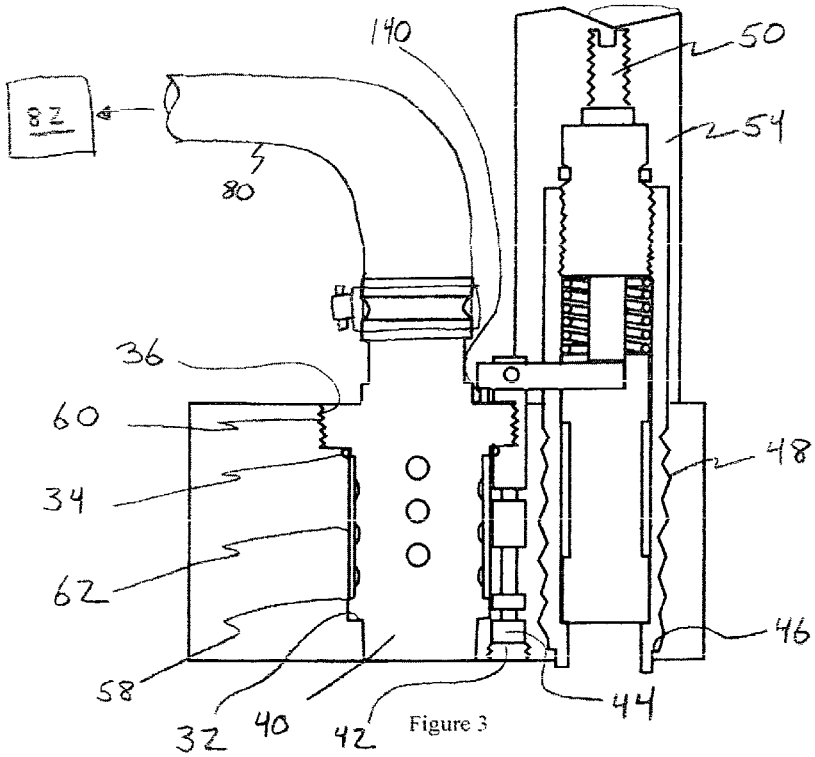
FIG. 3 is a partial cross sectional view taken along line 3-3 of FIG. 2.

Referring to FIG. 2 & FIG. 3, a tool head member (12) is shown. The tool head member (12) is typically made of aluminum. However, various other materials may be used without departing from the spirit of the invention. For example, cast iron, composites, and the like that is capable of maintaining a generally rigid configuration during sizing and lubricating cast bullets (19). The tool head member has an outer configuration that matches the respective reloading press (16). For example, an outer flange may be required for engagement with a slot in the tool head support (17). The tool head member (12) includes a sizing die bore (20), a lube valve bore (22), a lube actuator bore (24), a lube well bore (26), a lube channel (28), and an optional heater channel (30). The sizing die bore (20) is a through bore that includes a step surface (32), a relief (34) for receiving an o-ring (36), and a threaded portion (38) for positioning, fluidly sealing, and fastening a sizing die (40) to the tool head member (12). It should be recognized that other sizing die bore (20) configurations may be utilized without departing from the spirit of the invention. For example, the through bore may be of one diameter with plugs installed for engaging the sizing die (40) with the tool head member (12). The lube valve bore (22) is a through bore that includes a set screw (42) that positions a lube valve (44) seals any fluid from exiting the lube valve bore (22) during operation. Although the set screw is shown (42), other devices well known in the art for sealing bores may be used with out departing from the spirit of the invention. In addition, the use of the set screw (22) enables a user to access the lube valve bore (22) for cleaning and inspection. It should be understood that other designs for the lube valve bore (22) may be utilized without departing from the spirit of the invention. For example, a cast tool head member (12) may not include a through bore and thus would not necessitate the use of a set screw (42). The lube actuator bore (24) is a through bore that includes a second step surface (46) and second threaded portion (48) for receiving a lube actuator member (50). Similar to the sizing die bore (20) other configurations for lube actuator bores (24) may be used without departing from the spirit of the invention. The lube well bore (26) typically includes a third threaded portion (49) and a fluid channel (52). Again, it should be recognized that various configurations may be used to secure a lube well (54) without departing from the spirit of the invention. The lube channel (28) is positioned in the tool head member (12), such that it intersects the fluid channel (52) of the lube well (54), the lube valve bore (22), and the sizing die bore (20). The lube channel (28) is generally a drilled passage requiring a set screw or the like for sealing. However, as stated previously, other devices may be used without departing from the spirit of the invention. In addition, the tool head member (12) may have a heater channel (30) adapted to receive a heating element (56) (not shown). The positioning of the heating element (56) is optimized to warm the lube well (54) which aids in communicating fluid through the lube channel (28). In this arrangement, the heating element (56) warms the stored fluid in the lube well (54) which increase the fluid characteristics of the fluid. In addition, the positioning of the heating element (56) away from the sizing die bore (20) permits the fluid to gradually return to desired viscosity for lubricating bullets as it is communicated through the lube channel (28).

Figure 5:
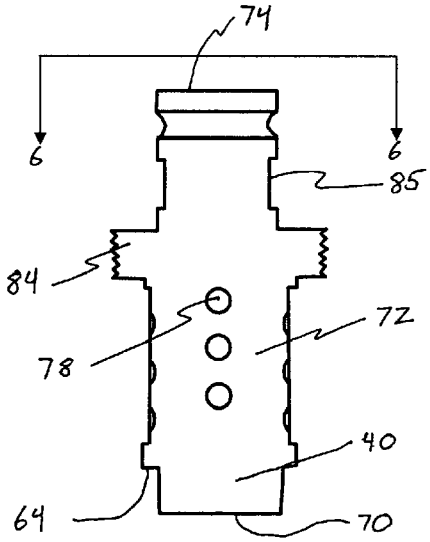
FIG. 5 is a side view of a sizing die of an embodiment of the present invention.
Figure 6:
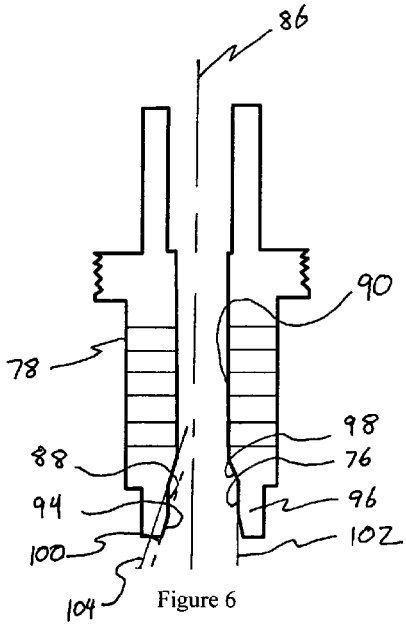
FIG. 6 is a partial cross sectional view taken along line 6-6 of FIG. 5.

Referring to FIG. 3, FIG. 5, and FIG. 6, the sizing die (56) is shown in one embodiment of the invention. The sizing die (56) is positioned in the sizing die bore (20). The sizing die bore (20) has a first portion (58), a second portion (60), and an intermediate portion (62) located between the first and second portions (58, 60). The first portion (58) generally corresponds to the step surface (32). The sizing die (40) has a locating surface (64) that engages the step surface (32) of the sizing die bore (20) for proper alignment of the sizing die (40) in the tool head member (12). The intermediate portion (62) of the sizing die bore (20) defines a lube chamber (68) between the tool head member (12) and the sizing die (40). In addition, the lube chamber (68) is in fluid communication with the lube channel (28). The sizing die (40) has a bullet entrance portion (70), a lube portion (72), a bullet exit portion (74), a bullet sizing bore (76). The bullet entrance portion (70) is adapted to receive bullets (19) to be sized and lubed. The lube portion (72) has at least one lube opening (78) that is adapted to communicate lube from the lube chamber (68) through the sizing die (40) and into the bullet sizing bore (76). The at least one lube opening (78) is configured to at least provide lube about the periphery and appropriate height of the bullet (19) needing lubricating. In one embodiment of the present invention, the at least one lube opening (78) are spaced at 90 degree intervals about the periphery of the lube portion (72) of the sizing die (40). It should be understood that other configurations may be used without departing from the spirit of the invention, such as, non-uniform spacing of at least one opening (78), singular openings, slots, and the like.

In addition, the size and geometric shape of the at least one opening (78) may vary in magnitude and shape based on the bullet (19) being sized and lubricated along with the type of lube being used. The bullet exit portion (74) is adapted to expel bullets (19) from the sizing die (40) after the bullets (19) have been sized and lubed. The expelled bullets (19) may be handled in a number of ways. For example, a hose (80) may be attached to the bullet exit portion (74) for guiding the expelled bullets (19) from the sizing die (40) to a storage container (82). In addition, the bullet exit portion (74) includes a connection member (84) that fastens the sizing die (40) to the tool head member (12). To facilitate fastening the sizing die (40) to the tool head member (12) a plurality of flats (84) are disposed about the bullet exit portion (74). The plurality of flats (84) is positioned to receive a tool, such as a wrench, for threadably engaging the connection member (84) of the sizing die (40) with the threaded portion (36) of the tool head member (12). The bullet sizing bore (76) is defined by a longitudinal axis (86). The bullet sizing bore (76) includes a centering portion (88), a sizing portion (90), and a release portion (92). The centering portion (88) has a first portion (94), a second portion (96), and a third portion (98). The first portion (94) is defined by a first axial axis (100). The first axial axis (100) intersects the longitudinal axis (86) generally at an angle between 2 and 15 degrees. The angle of the first portion is characteristic of a preliminary centering of the bullet (19) during the bullet (19) sizing and lubricating process. The second portion (96) is defined by a second axial axis (102).

The second axial axis (102) is generally parallel with the longitudinal axis (86). The angle of the second portion (96) is characteristic of guiding the bullet (19) from the first portion (94) to the third portion (98). The third portion (98) is defined by a third axial axis (104). The third axial axis (104) intersects the longitudinal axis (86) generally at an angle between 2 and 15 degrees. The angle of the third portion (98) is characteristic of centering the bullet (19) at the start of sizing the bullet (19) without scrubbing, i.e., damaging the bullet (19) being sized. The sizing portion (90) is defined by the longitudinal axis (86) and corresponds to a finish diameter for a bullet (19) being sized. Cast bullets (19) begin with a diameter that is oversized compared to the finished bullet/cartridge configuration. Pressing the bullet (19) through the sizing die (40) and in particular, the second portion (96) of the bullet sizing bore (76) adjust the oversized cast bullet to the desired dimension. The release portion (92), is sized such that the sized and lubed bullet (19) is smaller in diameter as compared with the release portion (92).

Figure 7:
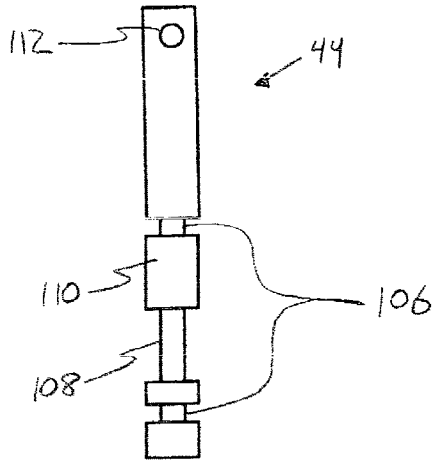
FIG. 7 is a side view of lube valve member of an embodiment of the present invention.
Figure 8:
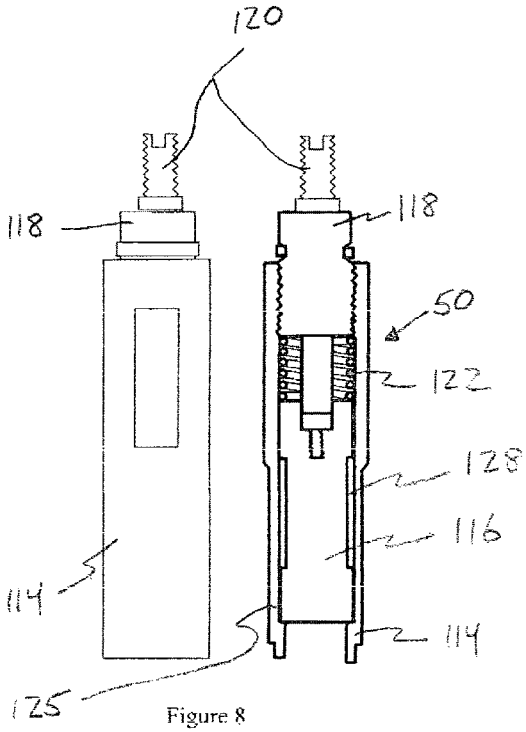
FIG. 8 is a partial cross sectional of a lube valve actuator member of an embodiment of the present invention.
Figure 9:
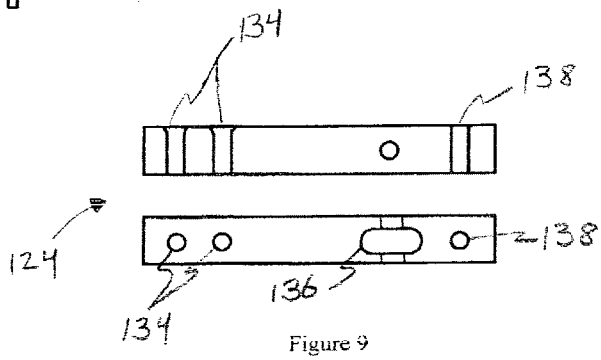
FIG. 9 is a side and top view of a plunger arm of an embodiment of the present invention.

Referring to FIG. 3 and FIG. 7, the lube valve (44) is shown. The lube valve (44) includes a pair of grooves (106), a passing cavity (108), a blocking portion (110), and a port (112).

The lube valve (44) is the device that passes fluid, i.e., lube through the lube channel (28) to the sizing die (40). The lube valve (44) is typically sealed by placing an o-ring seal in each of the pair of grooves. (106). As mentioned previously, other sealing mechanisms may be used that are well known in the art without departing from the spirit of the invention. The passing cavity (108) and the blocking portion (110) are located in between at least two of the plurality of grooves (106). The passing cavity (108) and the blocking portion (110) control the flow of fluid around the lube valve (44). For example, during operation, the lube valve (44) at rest has the blocking portion (110) adjacent to the lube channel (28) and thus blocks fluid from passing around the lube valve (44). At a certain point based on the type of bullet (19) being sized and lubed, the lube valve (44) is slideably moved in the lube valve bore (22) such that the blocking portion (110) is moved away from the lube channel (28) and is replaced by the passing cavity (108). The configuration of the passing cavity permits the fluid in the lube channel (28) to pass around the lube valve (44) and continue through the lube channel (28) to the sizing die (40). In addition, the lube valve (44) has a port for receiving a roll pin for connection to the lube actuator member (50). It should be recognized that various other mechanisms may be used to connect the lube valve (44) with the lube valve actuator (50). For example, screw(s), bolt(s), adhesives, and the like may be used without departing from the spirit of the invention.

Referring to FIG. 3, FIG. 8 thru FIG. 11 the lube actuator member (50) is shown. The lube valve actuator member (50) has an outer housing (114), an actuator plunger (116), a tension plug (118), a stop rod (120), a return mechanism (122), and a plunger arm (124).

The outer housing (114) has a central bore (124) that is adapted to receive the actuator plunger (116), the tension plug (118), the stop rod (120), return mechanism (122), and the plunger arm (124). The actuator plunger (116) is slidably placed in the central bore (124) and is generally maintained at a first position (128), i.e., rest position (128) by the return mechanism (122). The stop rod (120) is in threaded engagement with the tension plug (118). Threading the stop rod (120) to a predetermined distance based on the bullet (19) being sized and lubed and generally stops the lube valve actuator (50) from reaching a second position (130) that might not achieve the desired level of lubrication for the bullet (19) being sized. The plunger arm (124) is fastened to the actuator plunger (116) using techniques that are well known in the art. For example, the plunger arm (124) may be fastened to the actuator plunger (116) using screws, bolts, adhesives, and the like without departing from the spirit of the invention. The outer housing (114) has a plunger arm slot (132) adapted to receive the plunger arm (124). The plunger arm slot (132) opens into the central bore (126). The plunger arm (124) extends through the plunger arm slot (132) and is connected to the lube valve (44) as previously discussed. The plunger arm slot (132) is dimensioned for accommodating various bullets (19) configurations that need to be sized and lubricated. The plunger arm (124) includes at least one fastening port (134) adapted to receive fasteners for attaching the plunger arm (124) to the actuator plunger (116). In addition, the plunger arm has an oversized opening (136) for receiving the attachment mechanism used to engage the plunger arm (124) with the lube valve (44).

The plunger arm (124) moves the lube valve (44) between first and second positions (128, 130). Having the opening oversized aids in assuring the travel between the lube valve (44) and the lube actuator member (50) is smooth and reliable. A stop port (138) is provided in the plunger arm (124) for placement of a second stop rod (140) that ensures the components maintain their desired first position (128) after each bullet (19) is sized and lubed.

Figure 4:
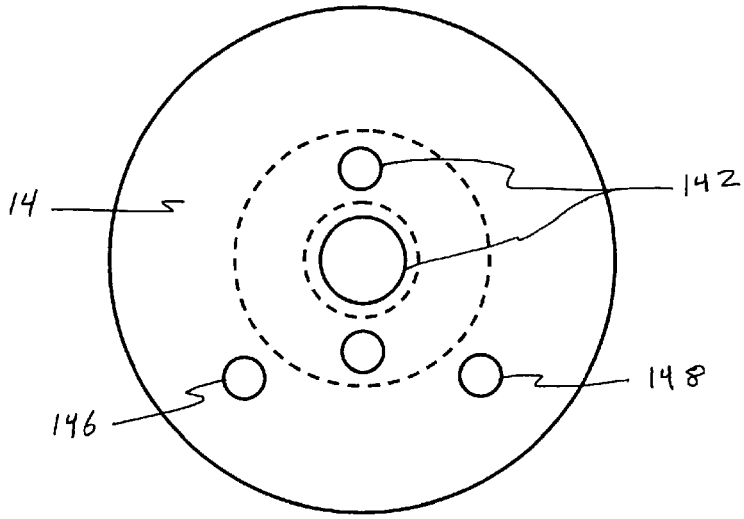
FIG. 4 is a top view of an adapter plate of an embodiment of the present invention.
Figure 10:
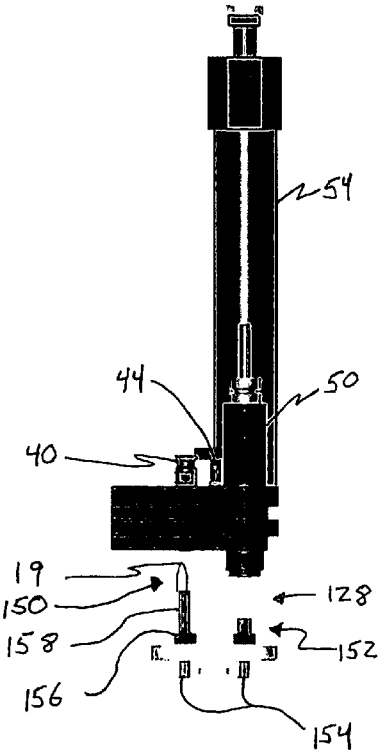
FIG. 10 is a partial side view of a bullet sizing and lubricator assembly at a first position of an embodiment of the present invention.
Figure 11:
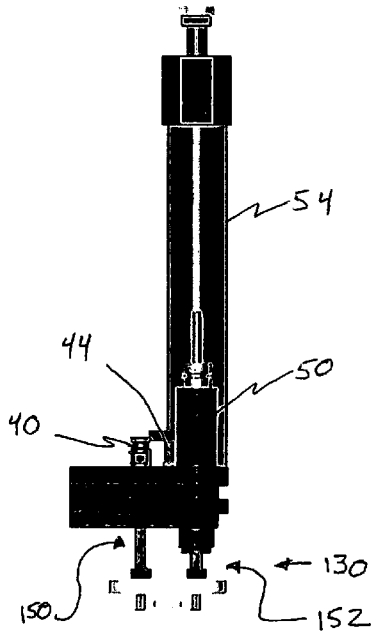
FIG. 11 is a partial side view of a bullet sizing and lubricator assembly at a second position of an embodiment of the present invention.

Referring to FIG. 4, FIG. 10, and FIG. 11 the adapter plate member (14) is shown. The adapter plate member (14) is fastened to the desired reloading press (16) using the mounting holes (142) that match with the adapter plate support (18). Generally reloading presses (16) have a main shaft (142) fastened to the adapter plate support (18) and a control linkage assembly (144). The control linkage assembly (144) translates an individuals input to movement of the main shaft (142). The adapter plate member (14) includes a sizing punch port (146) and an actuator punch port (148). The sizing and actuator punch ports (146, 148) are adapted to receive a sizing punch (150) and an actuator punch (152). Each of the sizing punch (150) and actuator punch (152) include a threaded portion (154), a set of flats (156) for receiving a tool, and bullet sizing portion (158). The sizing and actuator punch (150, 152) are threaded into their corresponding port (146, 148) in the adapter plate member (14). The bullet sizing portion (158) is dimensioned to not only push the bullet (19) being sized through the sizing die (40) but also position the bullet (19) in the sizing portion (90) of the sizing die (40) when the lube actuator member (50) engages the lube valve (44) and fluid is passed around the lube valve (44) and thus lubes the bullet (19) being sized. In some applications, based on bullet (19) dimensions additional height might be required with one of the sizing and actuator punches (150, 152). For example, longer bullets (19) might be positioned in the sizing portion (90) prior to having the lube valve (44) at the second position (130). In these instances, washers may be placed between the set of flats (156) and the adapter plate member (14), as shown in FIG. 11.

It should be recognized that various embodiments may be utilized without departing from the spirit of the invention. For example, discussion of the instant invention has primarily used a multi stage reloading press (16) as one example. However, with minor modifications to the tool head and adapter members (12, 14), single stage presses, turret presses, and the like would benefit from use of the instant invention.

Industrial Applicability

With reference to the figs. and in operation, improved sizing and lubrication of bullets (19) is achieved by utilizing the present invention. The present invention refits single stage, multistage reloading presses (16), and turret presses. For discussion, operation will be described using the multistage reloading press (16) understanding that various other configurations may be utilized without departing from the spirit of the invention. The adapter plate member (14) is fastened to the adapter plate support (18) of the reloading press (16). Appropriate sizing punch (150) and actuator punch (152) are selected and installed in the adapter plate member. In addition, the tool head member (12) engages the tool head support (17), in this embodiment, with slidable engagement. However, other techniques, such as fastening, and the like may be used without departing from the spirit of the invention. Based on the bullet (19), the tool head member (12) has the appropriate sizing and lubricating members disposed therein. A predetermined sizing die (40) is selected based on desired bullet (19) characteristics, such as, finished desired diameter and location of grooves to be lubricated. In addition, the type of lube to be used is selected and the corresponding lube well (54) is selected. Having the lube well (54) in threaded engagement with the tool head member (12) facilities quick and efficient changing between different lubes. For example, bullets (19) with large grooves for lubrication may benefit from having a less viscous lube. In contrast, smaller grooves may benefit from a more viscous lube. In addition to having the appropriate sizing die (40) and lube well (54) in the tool head member (12) the lube valve (44) and lube actuator member (50) are installed in their corresponding bores (22, 24). The bullet (19) to be sized and lubricated is positioned on the sizing punch (150). The user of the reloading press (16) then initiates movement of the control linkage assembly (144) which moves the adapter plate member (14) from the first position (128) towards the tool head member (12). Continued movement initiates engagement of the bullet (19) with the bullet sizing bore (76) of the sizing die (40). In particular, the bullet is being centered by the configuration of the first, second, and third portions (94, 96, 98) of the centering portion (88). The centered bullet (19) then continues through the sizing portion (90) of the sizing die (40) where the bullet's (19) diameter is squeezed to the appropriate finished dimension. Concurrently, movement of the adapter plate member (14) also engages the actuator punch (152) with the lube actuator member (50). Once the bullet (19) is being sized corresponds to having the lube actuator member at the second position (130), such that, the passing cavity (108) is open to the lube channel (28) and lube is communicated through the lube channel (28) to the lube chamber (68) formed between the tool head member (12) and the sizing die (40). The fluid then passes through the at least one lube opening (78) and into the bullet sizing bore (76). The fluid then lubricates the bullet (19) being sized. The bullet (19) being sized to the desired finished dimensions provides a friction fit between the bullet (19) and the sizing bore (76). This friction between the bullet (19) and the sizing bore (76) aids in sizing and lubricating numerous bullets (19) in one sitting. For instance, Once the bullet has been sized and lubricated, i.e., the lube valve has reached the second position (130), the adapter plate member (14) is the returned to the first position (128). Another bullet (19) is placed on the sizing punch (150) and the same technique is used. This time, when the bullet (19) reaches the stage of being sized it comes in contact with the prior bullet (19). Continue movement to the second position (30) pushes the prior bullet (19) from the sizing portion (90) to the release portion (92) where the bullet (19) may be easily retrieved. In addition, with numerous bullets (19) being sized, it may be advantages to attach hose (80) that leads to the storage container (82). In this manner the bullets (19) are pushed through the sizing die (40) into the hose (80) and into the storage container (82).

In applications using heating elements, the heating element is disposed in the heater channel (30) for direct warming of the lube well (54). Heating the fluid, in particular, viscous fluid stored in the lube well (54) aids in communicating fluid to the bullet (19) being sized and lubricated. In addition, warming at the lube well (54) allows the fluid to cool slightly by the time the fluid lubricates the bullet (19) providing the desired lubrication characteristics.

Cleaning of the tool head member (12) is easily achieved by releasing the lube well (54) from the tool head member (12). Removal of the lube well (54) provides access to the lube channel (28) for cleaning and inspection. In the event further inspection and/or cleaning is desired then the user may easily remove the set screw (42) to gain access to the lube valve bore (22).

The method of sizing and lubricating a bullet with ammunition re-loaders (16) having the tool head support (17), and the adapter plate support (14), the tool head member (12) which has a sizing die (40), the lube valve (44), the lube valve actuator (50), and the lube well (54) disposed therein, and the adapter plate member (14) having a sizing punch (150), and a actuation punch (152). The method includes the steps of placing the tool head member (12) into the tool head support (17). Placing the adapter plate member (14) onto said adapter plate support (14). Placing the sizing punch (150) and the actuation punch (152) on the adapter plate member (14). Placing the bullet (19) on the sizing punch (150). Operating the ammunition re-loader (16) by moving the adapter plate member (14) towards the tool head member (12). Engaging the bullet (19) with the sizing die (40), and the engagement centers and sizes the bullet (19). Engaging the actuator punch (152) with the lube actuator member (50), and the engagement permits fluid to flow from the lube well (54) into the sizing die (40) and about the bullet (19). Passing another bullet (19) from the sizing die (40).

Bullet (19) sizing and lubricating devices that utilize the present invention has improved operation, usage, simplicity of operation, economics, and longer life. The ability to use sizing dies (40) for many different dimensions of bullets (19) reduces complexity by changing nose punches and the like that are well known in the art. In past designs, it was not easy if at all possible to change the lube well (54). Incorporating the present invention facilitates quick and efficient usage of different lubes. In past usage, users may have used a lube that might not been the exact type called for due to the difficulty in changing lubes where the present design easily adapts to different lubes. In addition, using the compound forces capable from reloading presses (16) allows a larger range of bullets (19) to be sized. Performance of sizing and lubricating bullets is directly related to having the bullet (19) centered in the sizing die (19). Past designs relied on the accuracy and knowledge of the user where the present invention guides the bullet through the sizing die (40) for centering of the bullet (19) and thus better quality of bullet (19) for firing. Furthermore, having a heating element as described provides improvements in communicating fluid through the lube channel (28).

Other aspects, objects and advantages of this invention can be obtained from a study of the drawings, the disclosure and the appended claims.

What is claimed is:

1. A tool head member for use with a reloading device having a tool head support and adapter plate support to size and lubricate bullets, comprising:

a sizing die bore defined by a first portion having a step surface, a sizing die having a locating surface being disposed in said sizing die bore, and said locating surface engaging said step surface, a second portion adapted to receive said sizing die, and an intermediate portion located between said first and second portions and defining a lube chamber between said sizing die bore and said sizing die;

a lube valve bore having a lube valve member disposed therein, said lube valve member having a first position and a second position, said first position generally blocks fluid from passing from said lube channel and said sizing die bore, and a second position generally communicates fluid from said lube channel and said sizing bore;

a lube actuator bore;

a lube well bore adapted to receive a lube well; and a lube channel being positioned between said lube well bore and said sizing die bore for fluidly coupling said lube well bore, said lube valve bore, and said sizing die bore.

2. A tool head member, as set forth in claim 1, wherein said sizing die and said sizing die bore being fluidly sealed with an o-ring.

3. A tool head member, as set forth in claim 1, wherein said lube chamber being in fluid communication with said lube channel.

4. A tool head member, as set forth in claim 1, wherein said lube actuator bore having a lube valve actuator member in threaded engagement with said tool head member, said lube valve actuator member having a central bore and a plunger arm slot opening into said central bore, an actuator plunger having a plunger arm connected thereto is slidably positioned in said central bore, and said plunger arm extends through said plunger arm slot.

5. A tool head member, as set forth in claim 4, wherein said plunger arm being fastened to said actuator plunger.

6. A tool head member, as set forth in claim 5, wherein activation of said plunger arm moves said lube valve member between said first and second positions.

7. A tool head member, as set forth in claim 1, wherein an adapter plate being supported the adapter plate support, said adapter plate having a rest position corresponding to blocking fluid from passing from said lube well bore to said sizing die bore, and an activation position wherein the bullet being centered in said sizing die by said base punch and said fluid being communicated to the said sizing die bore by said valve actuation punch.

8. A tool head member, as set forth in claim 1, wherein said tool head member having a heating element disposed therein, said heating member being at least partially positioned underneath said lube well bore, and said heating element generally heats said fluid.

9. A tool head member, as set forth in claim 8, wherein said heating element generally heats said tool head member.

* * * * *